United States Patent [19]

Boser

[11] Patent Number: 5,038,691

[45] Date of Patent: Aug. 13, 1991

[54] SEWING PROCEDURE FOR PIPING OR THE LIKE

[76] Inventor: Ronald Boser, 711-3 Koehler Ave., Ronkonkoma, N.Y. 11779

[21] Appl. No.: 520,735

[22] Filed: May 9, 1990

[51] Int. Cl.[5] ..... D05B 27/22; D05B 35/06

[52] U.S. Cl. ..... 112/262.1; 112/315

[58] Field of Search ..... 112/262.1, 137, 138, 112/315, 316

[56] References Cited

U.S. PATENT DOCUMENTS

| | | | |
|---|---|---|---|
| 665,445 | 1/1901 | Knickerbocker | 112/137 |
| 1,536,812 | 5/1925 | Rocke | 112/137 |
| 4,154,179 | 5/1979 | Arnold | 112/262.1 |
| 4,312,290 | 1/1982 | Norz | 112/315 |
| 4,404,919 | 9/1983 | Martell et al. | 112/262.1 |
| 4,548,143 | 10/1985 | Martell et al. | 112/262.2 |
| 4,691,652 | 9/1987 | Leclaire | 112/262.1 |
| 4,962,715 | 10/1990 | Hyodo et al. | 112/316 |

*Primary Examiner*—Werner H. Schroeder
*Assistant Examiner*—Sullivan C. Prak

[57] ABSTRACT

In the sewing attachment of appearance-enhancing piping along the edge of material, a seam using initially applied larger stitches and at the trailing edge smaller stitches effective to tack the seam against unraveling, and a cutter located to sever the piping flush with the end of the material, so that after-sewing trimming is not required.

3 Claims, 2 Drawing Sheets

SEWING PROCEDURE FOR PIPING OR THE LIKE

BACKGROUND OF THE INVENTION

The present invention relates generally to the sewing attachment of piping or similar appearance-enhancing trimming of garment panels or other cloth material workpieces, and more particularly to an improved sewing procedure which simultaneously with the severing of the bobbin and needle threads contemplates trimming removal of the piping flush with the end of the workpiece, so as to obviate any trimming operation subsequent to the sewing operation.

In each known prior art sewing procedure for attaching edge piping to cloth materials, the individual material pieces are processed through the sewing machine in end—to—end alignment, while the piping is fed through a folding attachment so as to assume a covering relation about the aligned edges of the pieces so as to provide a finished appearance thereto, and stitched seam joins the piping to the material pieces. The procedure contemplates that the bobbin and needle threads of the attaching seam be severed to release the individual workpieces, and it is also required that the lengths of piping extending beyond the leading and trailing edges of the workpiece also be trimmed flush with these ends. These trimming operations add to the expense and handling of the workpieces.

SUMMARY OF THE INVENTION

Broadly, it is an object of the present invention to provide a sewing procedure obviating the above and other shortcomings of the prior art. More particularly, it is an object to provide a sewing procedure in which the attaching seam can be trimmed flush with the end of the sewn material, so that bobbin and needle threads, as well as any excess piping, are simultaneously removed with minimum expense and handling.

Underlying the present invention is the recognition that in trimming the attaching seam for the piping flush with the material edge it is, of course, necessary to prevent unravelling of the seam, and that this objective can be achieved using the stitch size control of the sewing machine, rather than the prior art technique of direction reversal. That is, both the within inventive stich size technique and the referred to prior art technique are effective in "tacking" the seam and obviating unravelling, but only the stitch size "tacking" according to the present invention enables the trimming to be done in a plane that is flush with the end of the cloth workpiece and thereby provides noteworthy benefits resulting therefrom, as all will be explained in greater detail subsequently.

The description of the invention which follows, together with the accompanying drawings should not be construed as limiting the invention to the example shown and described, because those skilled in the art to which this invention appertains will be able to device other forms thereof within the ambit of the appended claims.

DESCRIPTION OF THE PREFERRED EMBODIMENT

Figure 1:
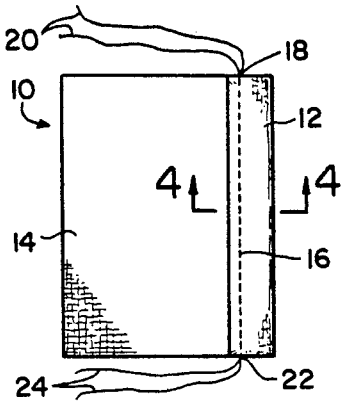
FIG.1 PRIOR ART
FIG. 1 is a plan view of a cloth workpiece with an edge piping in sewn attachement thereto which illustrates a prior art sewing procedure.

Shown in FIG. 1 is a conventional assembly 10 comprised of a piping edging 12 that has been machine sewn to a cloth or similar material workpiece 14 along a seam 16 to finish the edge of the cloth 14. Typically, as at 18, which will be understood to be the beginning of seam 16, there are unattached lead lengths of needle and bobbin threads 20 which must be removed in a trimming operation. Similarly, as at 22, which is the trailing end of seam 16, the unattached lengths of needle and bobbin threads 24 also remain after sewing the piping and must be trimmed off. Moreover, if the finished assembly 10 is to have a neat and commercially acceptable appearance, threads 20 and 24 must be clipped flush with respective seam ends 18 and 22. Even after trimming, the prior art contemplates imparting additional sewing to the seam 16 otherwise it will tend to unravel with consequent separation of piping 12 from piece 14.

Figure 2:
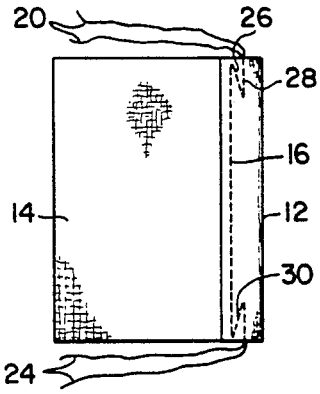
FIG.2 PRIOR ART
FIG. 2 is a view similar to FIG. 1 in which the prior art sewing procedure further includes "tacking" the ends of a seam.

A common technique employed to limit unravelling is illustrated in FIG. 2 wherein the direction of stitching is reversed at 26 after the first few forward stitches 28. The stitch reversal is also carried out on the trailing end of seam 16 at 30.

This stitch reversal technique is widely known as "tacking the ends of the seam". Although the "tacks" are illustrated in zig-zag pattern, the initial stitching 28 and reverse stitching 26 are actually done in the same line as seam 16 which results in a binding of fabric 14 and "tack" stitches that resists unravelling of seam 16 after threads 20 and 24 have been trimmed.

Figure 3:
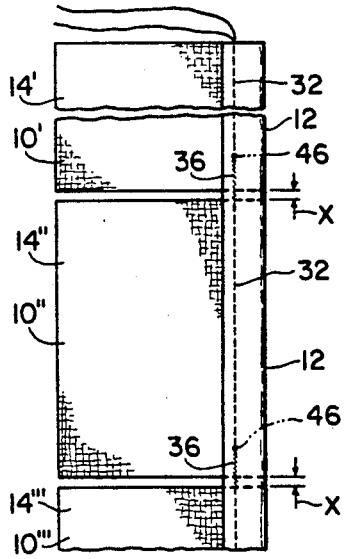
FIG.3 PRIOR ART
FIG. 3 is still another view similar to FIG. 1 but showing a more complex technique for "tacking" the ends of a seam.
Figure 5:
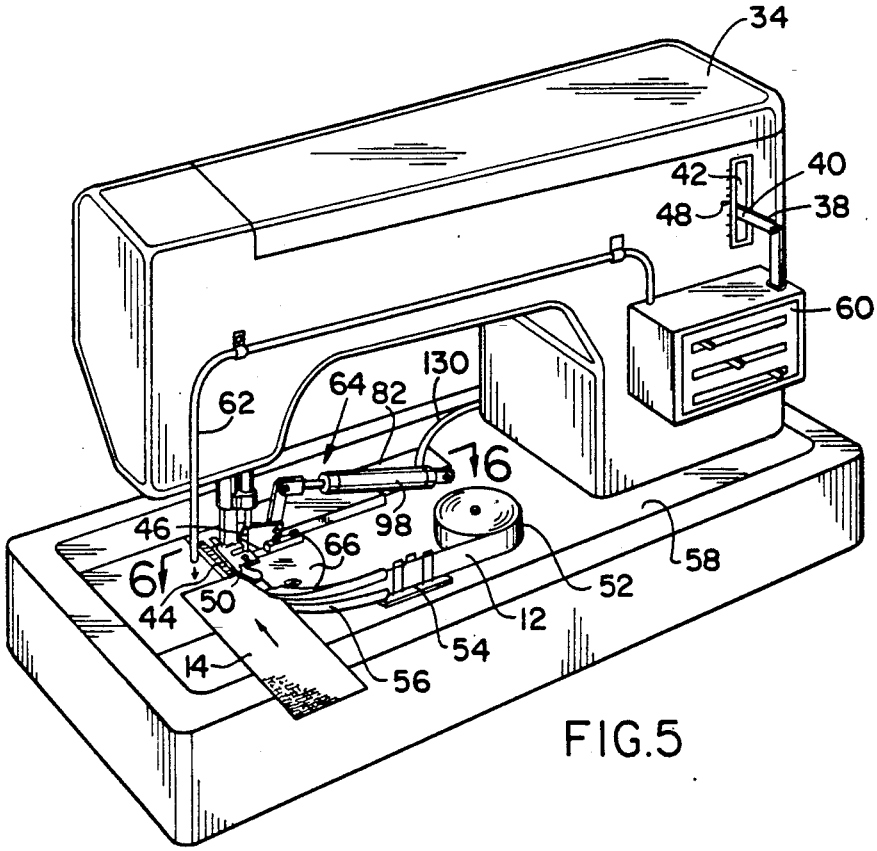
FIG. 5 is a perspective view of a conventional sewing machine adapted to practice the sewing procedure of the present invention.

FIG. 3 illustrates cloth workpieces 14', 14'', 14''' to which a piping trim 12 has in a well understood manner been sewn along seam 32. As understood, seam 32 can be sewn on a conventional sewing machine 34 (FIG. 5) that has manual stitch condensing control 38. Lever 40 is used to regulate the "throw" of feed dogs 44 as they advance fabric 14 past sewing needle 46 during sewing. When lever 40 is in its lowermost position the number of stitches of seam 32 are the largest (perhaps as long as five stitches to the inch) and with the feed dogs 44 feeding in the forward direction. Depending on conditions such as type of cloth, manufacturers' recommendations, and production requirements, the operator of machine 34 can raise lever 40 towards the midpoint 48 of slot 42 to condense the length of each stitch in seam 32 to perhaps 1/16" long which is typically "normal" for most commercial sewing requirements. Once lever 40 is adjusted above midpoint 48 the feed dogs 44 reverse the direction of fabric feed. The stitches in seam 32 become proportionately longer, the further above or below point 48 that lever 40 is positioned. Control 38 therefore is used to determine the length and direction of stitches in seam 32.

To produce an assembled piece such as 14" (FIG. 3) a skilled operator may start to sew piece 14' in the conventional manner as was done in FIGS. 1 and 2. As the trailing end of workpiece 14' approaches needle 46 the operator "condenses" stitches in seam 32 using an appropriate setting of control 38 to provide a minimum stitch length of perhaps less than 1/32" for the remaining ⅛" to ¼" length of the seam imparted to the work piece 14'. The operator then proceeds to allow the condensed stitches 36 to constitute the attaching seam even beyond the trailing edge of piece 14' for a distance X of sewing in the piping 12. Sewing is then stopped, foot 50 is raised and workpiece 14" is next placed within the fold of piping 12, close to needle 46. Then control 38 is readjusted to "normal", foot 50 is lowered and sewing for workpiece 14" is commenced. Seam 32 is sewn along piece 14" until the trailing edge approaches needle 46. The operator then condenses stitches 36 in seam 32 for the last ⅛" or so and lets the condensed stitches 36 extend onto piping 12 for a second distance X, whereupon the cycle is repeated. Assemblies 10 are then severed manually or automatically between adjacent pieces. It is to be noted that the repective lead and trailing threads 20 and 24 occur only on the first assembly 10' and the last assembly 10'''.

It is known that, when condensed stitches 36 are made in seam 32 or the like, there is a binding or knotting of fibers in the cloth 14 and its attached piping 12, and that the machine-applied threads of stitches 36 effectively resist unravelling after the severing thereof at the trailing end of cloth 14. It has been observed that the smaller stitches 36 are made, the tighter is the referred to binding effect, and thus the more stable is seam 32 at the sever point.

Figure 4:
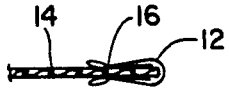
FIG. 4 is an enlarged scale sectional view taken along line 4—4 of FIG. 1.

The operations illustrated and demonstrated by FIGS. 1, 2 and 3 can be performed by any one of several commercially available sewing machines 34. It is the prior art practice for the operator also to have a mounted supply of piping 52 (FIG. 5) with a ribbon guide 54 and folder chute 56. Folder chute 56 is designed to bring piping ribbon 12 into the double fold shape (FIG. 4) about the edge of workpiece 14 just in front of foot 50. Devices 52, 54 and 56 are mounted in any convenient, suitable fashion upon machine base 58.

When machine 34 is adapted for the present invention, it is preferred that an Eska Modular V730 control Unit 60 commercially available from Eska of America, Inc., Atlanta, Ga. be mounted nearby and connected to lever 40 of stitch condensing control 38. Unit 60 is equipped with detecting means 62 that sense the trailing edge of workpiece 14.

Figure 6B:
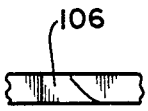
FIG. 6*b* is a sectional view taken along line 6*b*—6*b* of FIG. 6*a*.
Figure 6A:
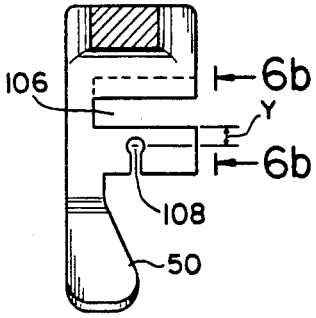
FIG. 6*a* is an enlarged scale perspective view of the sewing foot omitted from FIG. 5.
Figure 6:
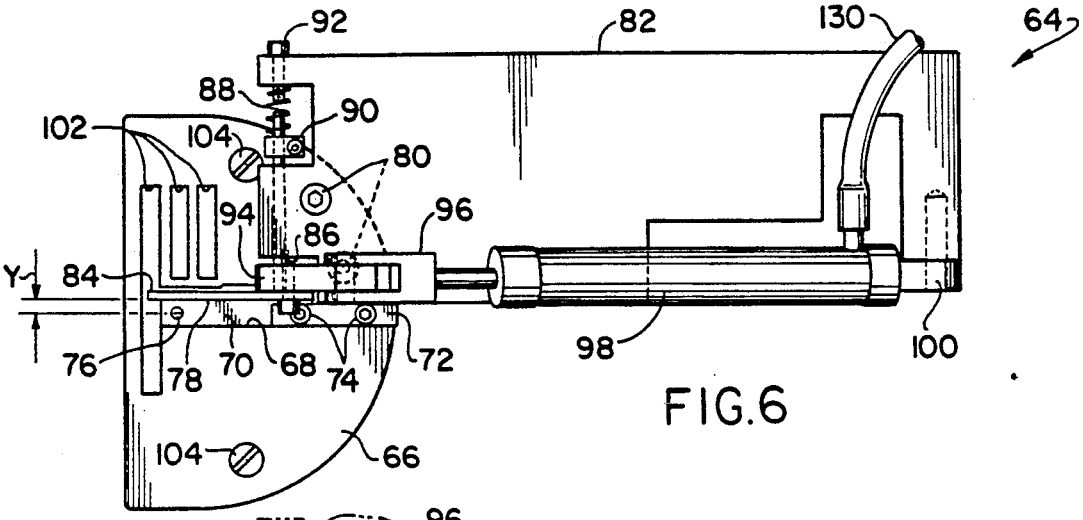
FIG. 6 is a plan view of a cutter accessory of the sewing machine as seen along line 6—6 of FIG. 5, simplified by the omission of the sewing foot.
Figure 7:
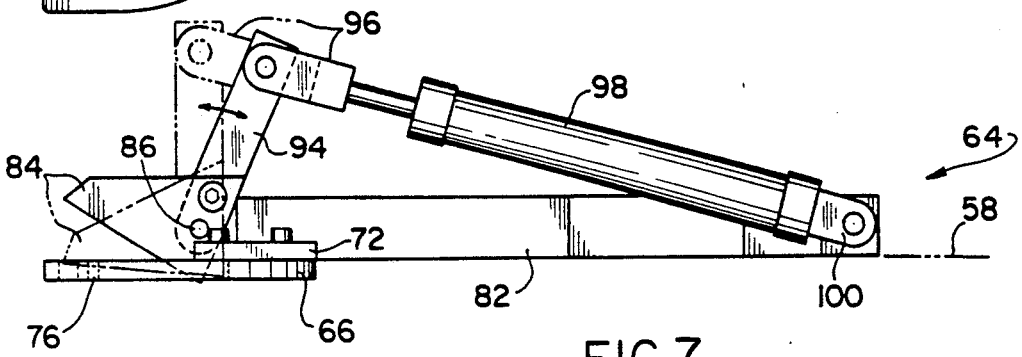
FIG. 7 is a front elevational view of the cutter shown in FIG. 6.

Shearing means or cutter 64, best seen in FIGS. 6 and 7, are attached to the feed dog plate 66. An opening 68 is provided in plate 66 to receive a stationary shear blade 70 which is attached by an arm extension 72 screwed to plate 66 by screws 74. Blade 70 is provided with a needle clearance hole 76 located a distance Y from the shear edge 78. A second pair of screws 80 is used to secure rectangular baseplate 82 to feed dog plate 66. Plate 82 supports a moveable shear blade 84 which rotates on shaft 86. Shaft 86 is journaled in base plate 82 and is spring biased towards stationary blade 70 by spring 88. Spring 88 cooperates with adjustable lock collar 90 and aligning screw 92 to produce a scissor action between blades 70 and 84. Blade 84 is provided with an arm extension 94 that is pivotably attached to clevis 96. Clevis 96 forms an end of an extendable air cylinder 98 whose opposite end 100 is pivotably connected to base 82. Cylinder 98 is periodically supplied with pressure air via hose 130 in accordance with the operational mode of control unit 60. This pressure air causes cylinder 98 to extend, moving clevis 96 and arm 94 counterclockwise, as seen in FIG. 7, which results in the scissor or cutting action of the blades 70 and 84, in a cutting plane immediately behind the feed dogs 44 that extend and operate through openings 102 in plate 66. Plate 66 is held in place within the machine base 58 by screws 104 while the attached shearing means baseplate 82 rests thereon.

In adapting machine 34 to practice the sewing procedure of the present invention, conventional foot 50 must be altered to version 50' as shown in FIG. 6*a*. This alteration consists of a slot 106 provided adjacent needle aperture 108 in the foot 50 to accommodate the pivotal cutter blade 84.

Figure 3B:
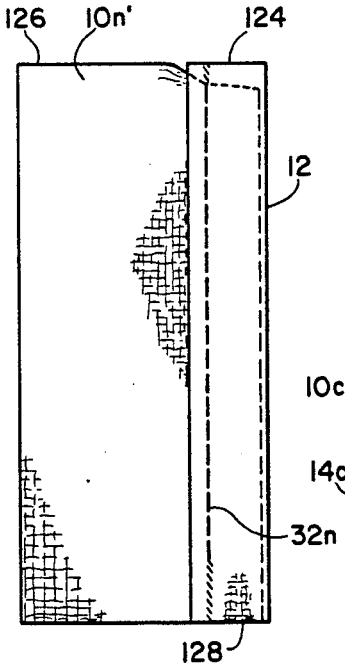
FIG. 3*b* is an enlarged scale plan view of a single, finished workpiece as prepared according to sewing procedure of the present invention.
Figure 3A:
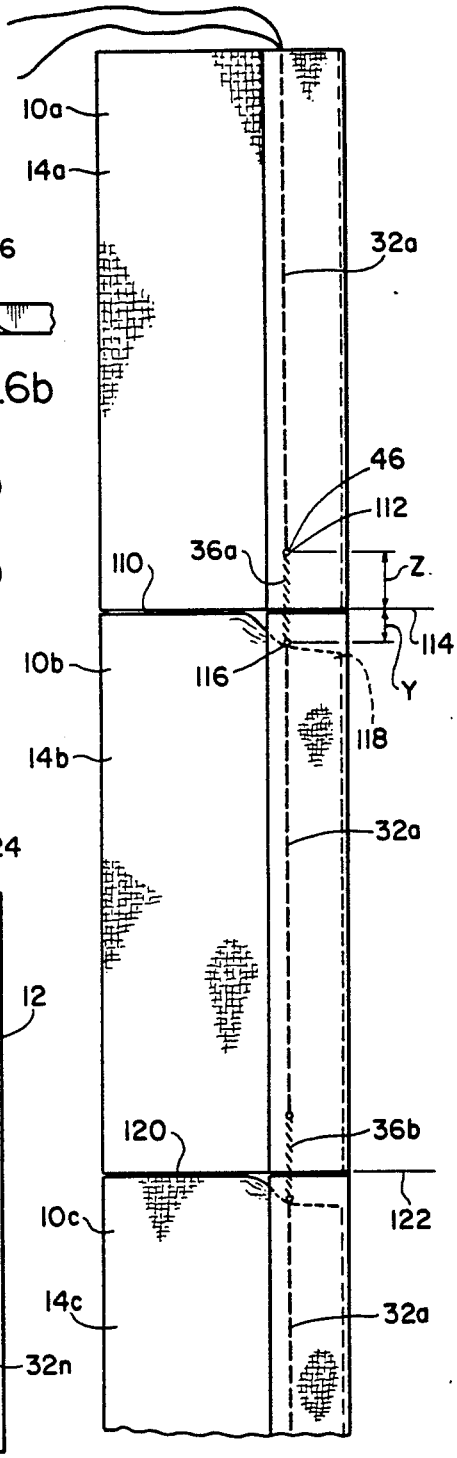
FIG. 3*a* is an enlarged scale plan view of piping sewn end to end to cloth workpieces according to the sewing procedure of the present invention.

In FIG. 3*a*, which is an enlarged scale figure similar to FIG. 3, there is a series of assemblies 10*a*, 10*b* and 10*c* that have been sewn using the within inventive sewing procedure on an approppriately adapted machine 34. To accomplish the illustrated sewing on a typical assembly such as 10*b* or 10*c*, the operator must program unit 60 and adjust detecting means 62. Detecting means 62 is set to detect trailing edge 110 of panel 14 when needle 46 is making "normal" stitches in seam 32*a* as at 112, i.e. a select distance Z from edge 110. When edge 110 passes under detector 62 a signal is received and interpreted by unit 60 which causes an adjustment movement in lever 40. Adjustment of lever 40 in turn results in the reduction of forward feed movement of feed dogs 44 producing condensed stitches 36*a*. Condensed stitches 36*a* are continued past edge 110 until edge 110 aligns with the cutting plane which is at 114, a distance Y from needle 46 and denoted by the reference 116. Unit 60 then stops machine 34 and signals air supply 130 to activate cylinder 98 and sever piping 12 and stitches 36*a* flush with edge 110 on the piece or panel 14*a*. Assembly 10*a* is now both trimmed, free, finished and ready to be removed from machine base 58, which occurs after foot 50' is raised. The few condensed stitches 36*a* in piping 12 between the shear plane 114 and needle location 116 remain effectively in "tack" or "tie a knot" formation between the needle thread and the bobbin thread for the short distance Y.

The operator now places workpiece 14*b* in the folded piping that emerges from folder chute 56 immediately before foot 50' and urges the lead corner 118 of panel 14*b* forward against needle 46 and the remaining condensed stitches 36*a* within distance Y. Foot 50' is lowered and control 60 is manually signalled to start sewing seam 32*a* with "normal" stitches. "Normal" stitches which join piping 12 to panel 14*b* continue along seam 32*a* until trailing end 120 of panel 14*b* is detected by means 62 whereupon condensed stitches 36*b* are produced on both sides of cutting plane 122. Severing at line 122 takes place as cutters 70 and 84 are activated and a flush cut occurs in the "tacked" seam ending to complete assembly 10*b*. The cycle is repeated again with workpiece 14*c*.

FIG. 3*b* illustrates a typical, complete assembly 10*n*', after finishing. Depending on operator skill, technique, material thickness, and such factors, the lead end of piping 12 at 124 has the appearance of being flush cut with edge 126 and will meet commercial standards. The trailing end of piping 12 at 128 is in actual fact flush cut to the degree provided by the adjustment and programming of units 62 and 60.

From the preceding description it should be readily appreciated that an adapted machine 34 when fitted with shearing or cutter means 64 and control means 60 and 62 produces a highly commercially desirable seam 32*n* with "tacked" ends and no leading and trailing threads 20 and 24. The within inventive sewing procedure for producing seam 32*n* among other advantages saves thread, produces a uniform product, and promotes an increased sewing efficiency.

While the particular piping attachment method herein disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of sewing a strip of piping about an edge of material to enhance the appearance thereof using a sewing machine having feed dogs to advance said material and said piping in covering relation about said material edge initially beneath a reciprocating sewing machine needle so as to impart a seam thereinto so as to attach said piping to said material and subsequently to advance the same to a cutter so as to trim said piping relative to a trailing edge of said material, the improvements to the aforesaid sewing comprising the steps of imparting said seam attaching said piping to said material using a first selected number of stitches per inch effective to hold said piping to said material but only for an extent terminating at a selected distance adjacent to the edge of said material, imparting said seam in said remaining distance starting adjacent to and extending beyond said said material edge using a second increased selected number of stitches per inch effective to tack said piping to said material so as to obviate the unravelling of said seam, and locating said cutter immediately adjacent to said sewing machine needle so that the cutting thereby of said sewn piping and material is in a plane correspondingly located immediately after the imparting, at the end of said seam, of said tack to said seam whereby said piping is trimmed flush with a trailing end of said material edge by said cutter so as to minimize any additional trimming thereof to provide a finished appearance to said piping in its sewn condition to said material edge.

2. The sewing procedure as claimed in claim 1 wherein said cutter is located perpendicular to the direction of sewing at a distance no more than 1/16 inch past the sewing needle.

3. The sewing procedure as claimed in claim 2 wherein each stitch of said second selected number of stitches is each one half the length of each stitch of said first selected number of stitches.

* * * * *